US009102136B2

(12) United States Patent
Kambara et al.

(10) Patent No.: US 9,102,136 B2
(45) Date of Patent: Aug. 11, 2015

(54) INK-JET PRINTER AND MEDIUM TRANSFER METHOD

(75) Inventors: Takaaki Kambara, Nagano (JP); Shinya Nakano, Nagano (JP)

(73) Assignee: MIMAKI ENGINEERING COMPANY, LTD., Tomi, Nagano (JP)

( * ) Notice: Subject to any disclaimer, the term of this patent is extended or adjusted under 35 U.S.C. 154(b) by 0 days.

(21) Appl. No.: 13/521,593

(22) PCT Filed: Jul. 12, 2010

(86) PCT No.: PCT/JP2010/061784

§ 371 (c)(1),
(2), (4) Date: Jul. 11, 2012

(87) PCT Pub. No.: WO2011/086718

PCT Pub. Date: Jul. 21, 2011

(65) Prior Publication Data

US 2013/0033553 A1 Feb. 7, 2013

(30) Foreign Application Priority Data

Jan. 13, 2010 (JP) ..... 2010-004958

(51) Int. Cl.

| | |
|---|---|
| ***B41J 2/01*** | (2006.01) |
| ***B41J 2/005*** | (2006.01) |
| ***B41J 11/00*** | (2006.01) |
| ***B41J 15/16*** | (2006.01) |
| ***B41J 11/06*** | (2006.01) |

(52) U.S. Cl.

CPC ..... *B41J 2/0057* (2013.01); *B41J 11/0085* (2013.01); *B41J 11/06* (2013.01); *B41J 15/16* (2013.01)

(58) Field of Classification Search

USPC ..... 347/104, 101

See application file for complete search history.

(56) References Cited

U.S. PATENT DOCUMENTS

| | | | | |
|---|---|---|---|---|
| 7,397,487 | B2 * | 7/2008 | Fukui | 347/139 |
| 2006/0066715 | A1 * | 3/2006 | Fukui | 347/262 |
| 2012/0042799 | A1 * | 2/2012 | Kojima | 101/474 |

FOREIGN PATENT DOCUMENTS

| | | | |
|---|---|---|---|
| JP | 2003-104600 | A | 4/2003 |
| JP | 2005-067103 | | 3/2005 |
| JP | 2006-321611 | A | 11/2006 |

(Continued)

OTHER PUBLICATIONS

International Search Report in corresponding Japanese Application, PCT/JP2010/081784, mailed Sep. 7, 2010, 4 pages.

*Primary Examiner* — Henok Legesse

(74) *Attorney, Agent, or Firm* — Finnegan, Henderson, Farabow, Garrett & Dunner, L.L.P.

(57) ABSTRACT

Provided are a ink-jet printer and a medium transfer method printer may include a placement section configured to attract a rolled medium, and to move in a direction parallel to a medium transferring direction, an ink discharging unit configured to move in a direction perpendicular to the medium transferring direction, an unwinding section configured to unwind the medium onto the placement section, and a winding section configured to wind the medium from the placement section. In addition, the ink discharging unit may be configured to discharge ink on the medium at the same time that the placement section moves in the direction of the medium transferring direction and while the placement section attracts the medium. Furthermore, the ink discharging unit also may be configured to discharge ink on the medium at the same time that the unwinding section unwinds the medium and the winding section winds the medium.

6 Claims, 8 Drawing Sheets

(56) References Cited

FOREIGN PATENT DOCUMENTS

| | | | | | |
|---|---|---|---|---|---|
| JP | 2007-313743 | A | | 12/2007 | |
| JP | 2008-012812 | A | | 1/2008 | |
| JP | 3146588 | U | | 11/2008 | |
| JP | 2009-143147 | A | | 7/2009 | |
| JP | 2008-127118 | | * | 11/2009 | ..... G03B 27/14 |

* cited by examiner

INK-JET PRINTER AND MEDIUM TRANSFER METHOD

FIELD OF THE INVENTION

The present invention relates to an ink-jet printer and a medium transfer method.

BACKGROUND

Ink-jet printer media may include, leaf type paper, cut paper, roll print paper (hereinafter called 'roll paper'), and so on. In general, for printing on printing paper of a leaf type paper or cut paper, and the like, the medium may be placed on a printing table, and the printing may be carried out by discharging ink while an ink-jet head moves in a scanning direction.

On the other hand, in the case of printing on long rolled paper, a mechanism for winding and unwinding the roll paper may be needed. For example, an ink-jet printer described in Japanese Unexamined Patent Application Publication No. 2005-67103 includes a feeding scroller for feeding roll paper, and a winding scroller for winding the roll paper printed. Thus, the ink-jet printer winds and unwinds the roll paper according to the printing on the roll paper.

SUMMARY OF INVENTION

Unfortunately, roll paper may bend when the roll paper is transferred. Therefore, in the case of a conventional ink-jet printer, an ink discharge position is unfavorably displaced due to the bending of the roll paper so as to degrade printing quality.

Thus, it is an object of the present invention to provide a medium transfer method through which printing quality may be maintained while printing on roll paper.

In accordance with an embodiment of the invention, an ink-jet printer is disclosed. The ink-jet printer may include a placement section configured to attract a rolled medium, and to move in a direction parallel to a medium transferring direction, an ink discharging unit configured to move in a direction perpendicular to the medium transferring direction, an unwinding section configured to unwind the medium onto the placement section, and a winding section configured to wind the medium from the placement section. In addition, the ink discharging unit may be configured to discharge ink on the medium at the same time that the placement section moves in the direction of the medium transferring direction and while the placement section attracts the medium. Furthermore, the ink discharging unit also may be configured to discharge ink on the medium at the same time that the unwinding section unwinds the medium and the winding section winds the medium.

At the time of printing on the rolled medium in the ink-jet printer, the medium may be unwound from the unwinding section and wound by the winding section, while the placement section moves in the direction of transferring the medium, with the medium being attracted by the placement section. Thus, the medium may be transferred while being fixed onto the placement section by attraction at the time of the printing, therefore this operation may prevent the medium from having a wrinkle or a bend at the time of the transfer. Accordingly, this operation may prevent an ink discharge position from being displaced due to a displacement at the time of transferring the medium. As a result, it becomes possible to maintain printing quality in the printing on the rolled medium.

Moreover, the ink-jet printer may further include a tension bar provided for both the unwinding section and the winding section. The tension bar may tension the medium. Since the tension bar may tension the medium, centering correction may be carried out for the medium placed on the placement section such that the medium may be transferred more stably. Accordingly, this operation may prevent the medium under printing at the time, from displacement such that a wrinkle, a distortion, and the like due to displacement of the medium may be suppressed. As a result, inconveniences may be avoided.

Furthermore, the medium may be tensioned by the weight of the tension bar. Accordingly, a simple structure may be materialized. Moreover, since the tension bar may move in accordance with operation of winding and unwinding the medium, the medium may be tensioned uniformly.

Moreover, while the winding section is locked, the placement section attracting the medium may move in a direction opposite to the direction of transferring. If the winding section is locked, the medium may be fixed and not moving in the direction opposite to the direction of transferring. Then, if the placement section attracting and fixing the medium moves in the direction opposite to the direction of transferring under these conditions, the placement section may drag away the medium such that a wrinkle on the medium, caused due to attraction, may be smoothed.

Furthermore, the tension bar provided at a side of the winding section and the winding section also may be locked. If the tension bar is not locked, the tension bar may move in accordance with the movement of the placement section to a position where the tension bar becomes locked. Since the medium may move in accordance with the movement of the placement section, it is possible that a wrinkle on the medium, due to the attraction, may not be smoothed as long as the tension bar keeps on moving. On this occasion, the winding section may be locked in order to fix the medium and not move it, and moreover the tension bar may be locked so that the wrinkle on the medium, due to the attraction, may be smoothed.

The method in which the ink-jet printer prints is also a novel feature of the invention. More specifically, a medium transfer method for an ink-jet printer according to the present invention may include the steps of attracting a medium to a placement section; moving the placement section in a direction parallel to a medium transferring direction; moving a head unit in a direction perpendicular to the medium transferring direction; unwinding the rolled medium onto the placement section; discharging ink on the medium by a head unit; and winding the medium. Additionally, discharging ink on the medium may occur while attracting the medium to the placement section, and while moving the placement section in the direction of the medium transferring direction.

Furthermore, while the winding section is being locked, the placement section attracting the medium may move in a direction opposite to the direction of transferring.

According to the present invention, printing quality may be maintained in printing on roll paper.

DESCRIPTION OF THE EMBODIMENTS

Figure 1:
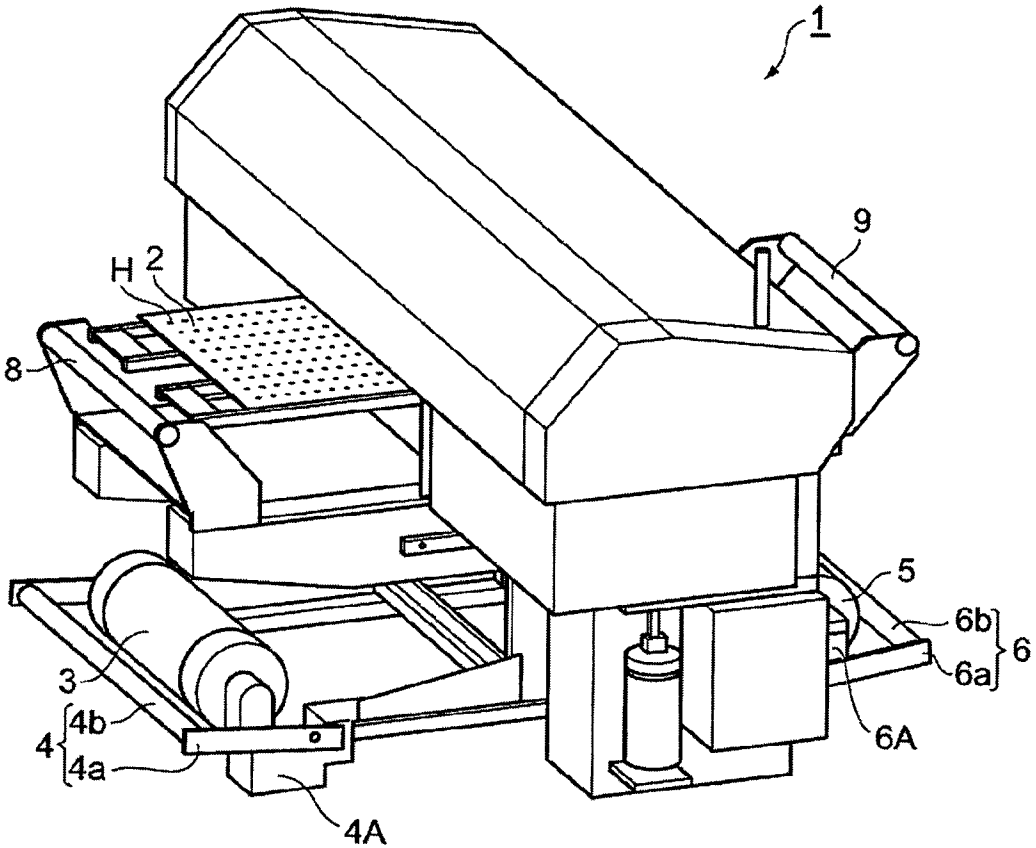
FIG. 1 is a front-side perspective view of an ink-jet printer according to an exemplary embodiment of the present invention.

An ink-jet printer and a medium transfer method according to the present invention are described below in detail with reference to the accompanying drawings. Incidentally, parts that are the same or equivalent to each other are provided with the same reference numeral in the drawings.

As shown in each of those drawings, an ink-jet printer 1 may be, for example, a UV-curing ink-jet printer of a flatbed type. The ink-jet printer 1 may be configured in such a way that; a table 2, on which a medium (an objective print material) may be placed, moves in a medium transfer direction according to printing operation, and in the meantime, a printing head 7 (Refer to FIGS. 6*a*-6*c*) may discharge ink while moving in a direction (scanning direction) perpendicular to the medium transfer direction. In the following description, a roll print paper (hereinafter, called roll paper 'M': Refer to FIGS. 6*a*-6*c*) is used as a medium.

The ink-jet printer 1 may include the table 2 (placement section) on which the roll paper 'M' is placed, an unwinding roller 3 (unwinding section) for unwinding the roll paper 'M', a first tension bar 4 placed at a side of the unwinding roller 3, a winding roller 5 (winding section) for winding the roll paper 'M', and a second tension bar 6 placed at a side of the winding roller 5. Moreover, the ink-jet printer 1 may include the printing head 7 for discharging ink, and the like, in addition. Incidentally, the ink-jet printer 1 may be controlled by a control unit that is not shown in the drawings.

The table 2 is a section on which the roll paper 'M', as an objective print material, may be placed and attracted. The table 2 is provided with a plurality of holes 'H' on its surface side, as well as a sucking mechanism (vacuum) that is not shown in the drawings. Thus, by means of sucking (negative pressure) with the sucking mechanism through the holes 'H', the roll paper 'M' placed on the table 2 may be fixed by attraction. Then, the table 2 may be placed on a rail, stretching in a front-back direction of the ink-jet printer 1, by the intermediary of a guide (not shown), and may be movable in a transfer direction of the roll paper 'M' by a drive unit that may be controlled by the control unit and not shown in the drawings. Incidentally, the table 2 may be provided in such a way as to be movable, for example, for 150 mm up and down with a lifting mechanism that is not shown in the drawings. Furthermore, being rotatable freely, a pair of rollers 8 and 9 may be provided at a front position and a rear position of the table 2.

The unwinding roller 3 may be a portion for unwinding the roll paper 'M' installed, onto the table 2. The unwinding roller 3 may be cylindrical and may be provided in an unwinding unit 4A positioned at a rear side of the table 2 in the transfer direction of the roll paper 'M.' The unwinding roller 3 may unwind the roll paper 'M' by using a drive unit (not shown), such as a motor, and the drive unit for driving the unwinding roller 3 may be controlled by the control unit. The amount of the roll paper 'M' to be unwound from the unwinding roller 3 may be adjusted through controlling the drive unit by the control unit, in accordance with a diameter of the roll paper 'M' (the amount of wound), a count value of an encoder detecting an RPM of the unwinding roller 3, and so on. Furthermore, the unwinding roller 3 may also wind the roll paper 'M' for the purpose of maintaining a height of the first tension bar 4 to be described later.

The first tension bar 4 may be a portion for providing tension for the roll paper 'M' to be unwound from the unwinding roller 3. The first tension bar 4 may be freely movable in a vertical direction (a direction of gravity). Concretely to describe, the first tension bar 4 may include a pair of support members 4*a* provided to the unwinding unit 4A of the ink-jet printer 1 so as to be able to freely turn, and a contacting member 4*b* that may be supported by the support members 4*a* and may contact the roll paper 'M.' The contacting member 4*b* may be cylindrical and may be provided along a direction in which the unwinding roller 3 stretches out.

The first tension bar 4 may be placed in such a way as to contact a rear surface of the roll paper 'M' within an interval between the unwinding roller 3 and the roller 8 in order to provide tension to the roll paper 'M.' Meanwhile, the first tension bar 4 may weigh, for example, approximately 1.5 kg. Thus, owing to such a structure, the first tension bar 4 may pull down the placed roll paper 'M' with its own weight within an interval between the unwinding roller 3 and the roller 8. Then, the tension (load) to be provided to the roll paper 'M' at the first tension bar 4 may be adjusted, for example, by installing a weight (load). Incidentally, the contacting member 4*b* may be provided to the support members 4*a* so as to be freely rotatable.

Figure 4:
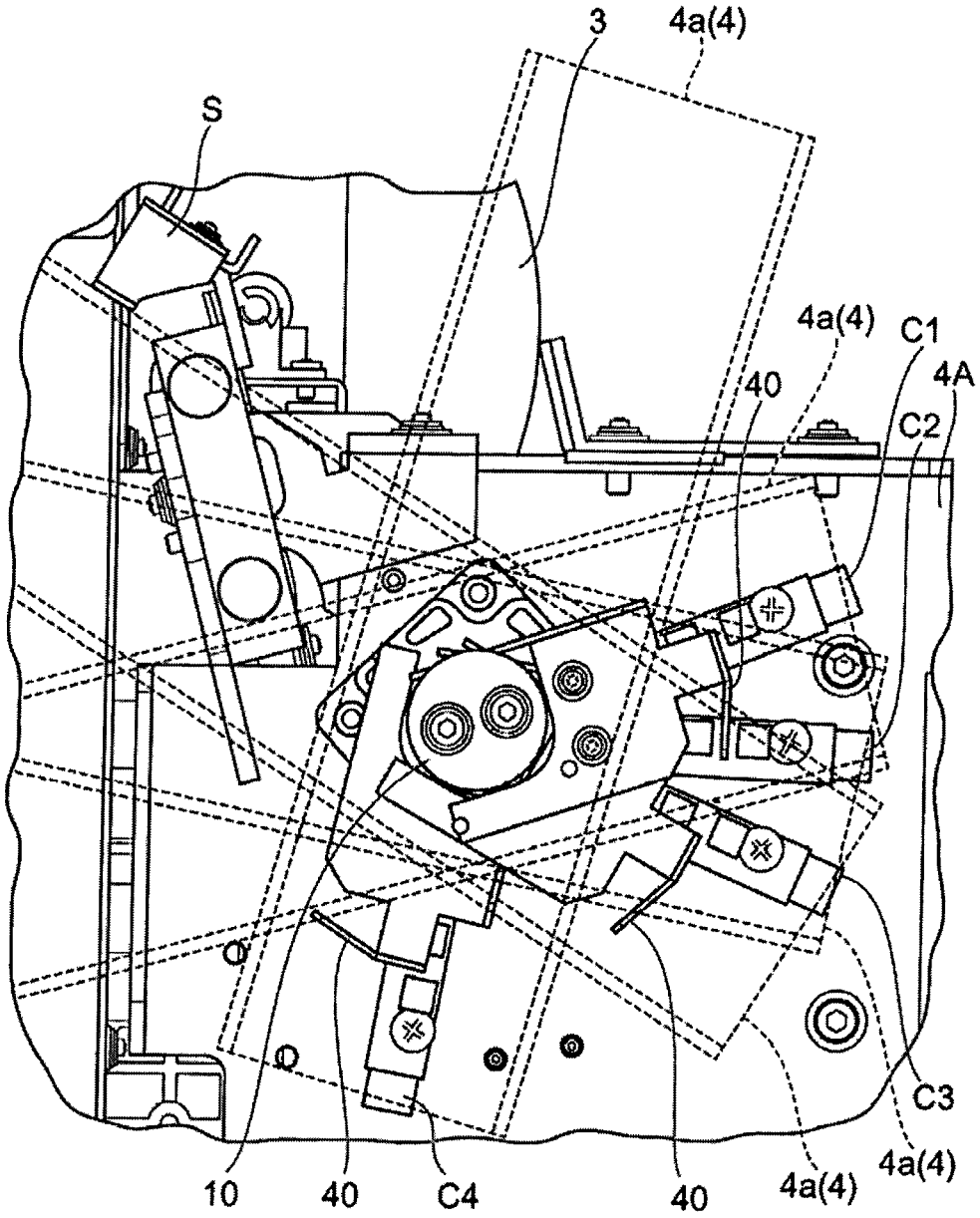
FIG. 4 is an enlarged view of an unwinding unit according to an exemplary embodiment of the present invention.

As shown in FIG. 4, the unwinding unit 4A may support a turning axis of the support members 4*a* and also may be provided with four sensors C1-C4 at a side section of the unwinding unit 4A. Each of the sensors C1-C4 may be a sensor for detecting an elevation of the contacting member 4*b* of the first tension bar 4. Specifically, a first sensor C1 may be provided in the unwinding unit 4A at a position that is at an upper side in relation to an elevation of a support shaft 10 supporting the first tension bar 4, the position also may be towards the right side in relation to a center of the support shaft 10 in the drawing. The first sensor C1 may detect an elevation of the contacting member 4*b* being at a lowest position by means of detecting a position of one end (being opposite to the other end where the contacting member 4*b* is provided) of the support members 4*a*. The lowest position may be located where the contacting member 4*b* is approximately 20 to 30 mm above a floor level.

A second sensor C2 may be provided in the unwinding unit 4A at a position having an elevation similar to the elevation of the support shaft 10, the position also may be towards the right side in relation to the center of the support shaft 10 in the drawing. Together with the first sensor C1, the second sensor C2 may detect the elevation of the first tension bar 4 being at the lowest position, by means of detecting the position of the one end of the support members 4*a*. Furthermore, together with a third sensor C3 to be described later, the second sensor C2 may detect a first operating position of the first tension bar 4 by means of detecting a position of the one end of the support members 4*a*. The first operating position may be at an elevation where the first tension bar 4 is around an intermediate position; and at the elevation, the unwinding roller 3 may start its winding operation. In other words, if the second sensor C2 turns on, the unwinding roller 3 may start winding the roll paper 'M' in order to maintain the first tension bar 4 at the first operating position.

The third sensor C3 may be provided in the unwinding unit 4A at a position that is towards a lower side in relation to the elevation of the support shaft 10, the position also may be towards the right side in relation to the center of the support shaft 10 in the drawing. Together with the second sensor C2, the third sensor C3 may detect the first operating position of the first tension bar 4 by means of detecting the position of the one end of the support members 4*a*. Furthermore, the third sensor C3 may detect a second operating position of the first tension bar 4. The second operating position may be located where the first tension bar 4 is at an upper point, and at that position the unwinding roller 3 may start its unwinding operation. In other words, if the second sensor C2 turns off under the condition of the third sensor C3 being on, the unwinding roller 3 may start unwinding the roll paper 'M' in order to maintain the first tension bar 4 at the second operating position.

A fourth sensor C4 may be provided in the unwinding unit 4A at a position that is towards the lower side in relation to the elevation of the support shaft 10, the position also may be towards a left side in relation to the center of the support shaft 10 in the drawing. The fourth sensor C4 may detect an evacuation position of the first tension bar 4 by means of detecting the position of the one end of the support members 4*a*. The evacuation position may be where the first tension bar 4 is at its highest position, and at that position the roll paper 'M' may be replaced or installed.

The first through fourth sensors C1-C4 described above may be, for example, optical sensors, and these sensors may detect an elevation of the first tension bar 4 by using a masking plate 40 provided to the first tension bar 4, which may interrupt the transmission of infrared light. The masking plate 40 may be provided at the one end of the first tension bar 4 in such a way that the masking plate 40 may react against two sensors, while extending over the two sensors. In other words, the masking plate 40 may be structured to individually interrupt infrared light with two neighboring sensors. In the case where none of the first through fourth sensors C1-C4 detects the masking plate 40, i.e., the masking plate 40 may be positioned between the third sensor C3 and the fourth sensor C4, it may be supposed that the first tension bar 4 is placed at a mechanical limit position. The mechanical limit position may be where a wrinkle-removing operation for the roll paper 'M' as described later is executed; and furthermore, the mechanical limit position may also be where the first tension bar 4 contacts a stopper 'S' provided to the unwinding unit 4A. Alternatively, the first through fourth sensors C1-C4 may include magnetic sensors and the like, instead of optical sensors.

The control unit described above may control the drive unit for the unwinding roller 3 to unwind and wind the roll paper 'M' according to an elevation detected by each of the first through fourth sensors C1-C4, in such a way that the first tension bar 4 may operate (move vertically) within a predetermined working range with respect to the elevation.

Figure 2:
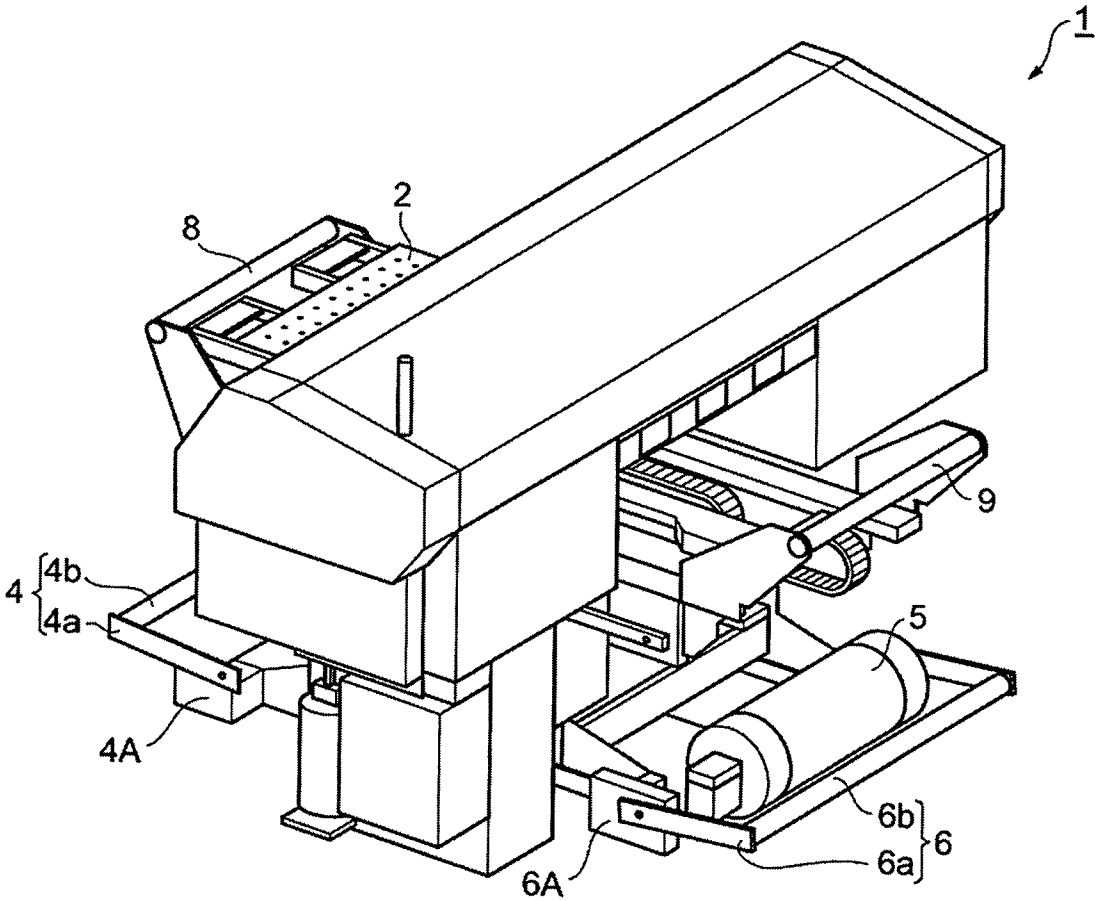
FIG. 2 is a rear-side perspective view of the ink-jet printer shown in FIG. 1.
Figure 3:
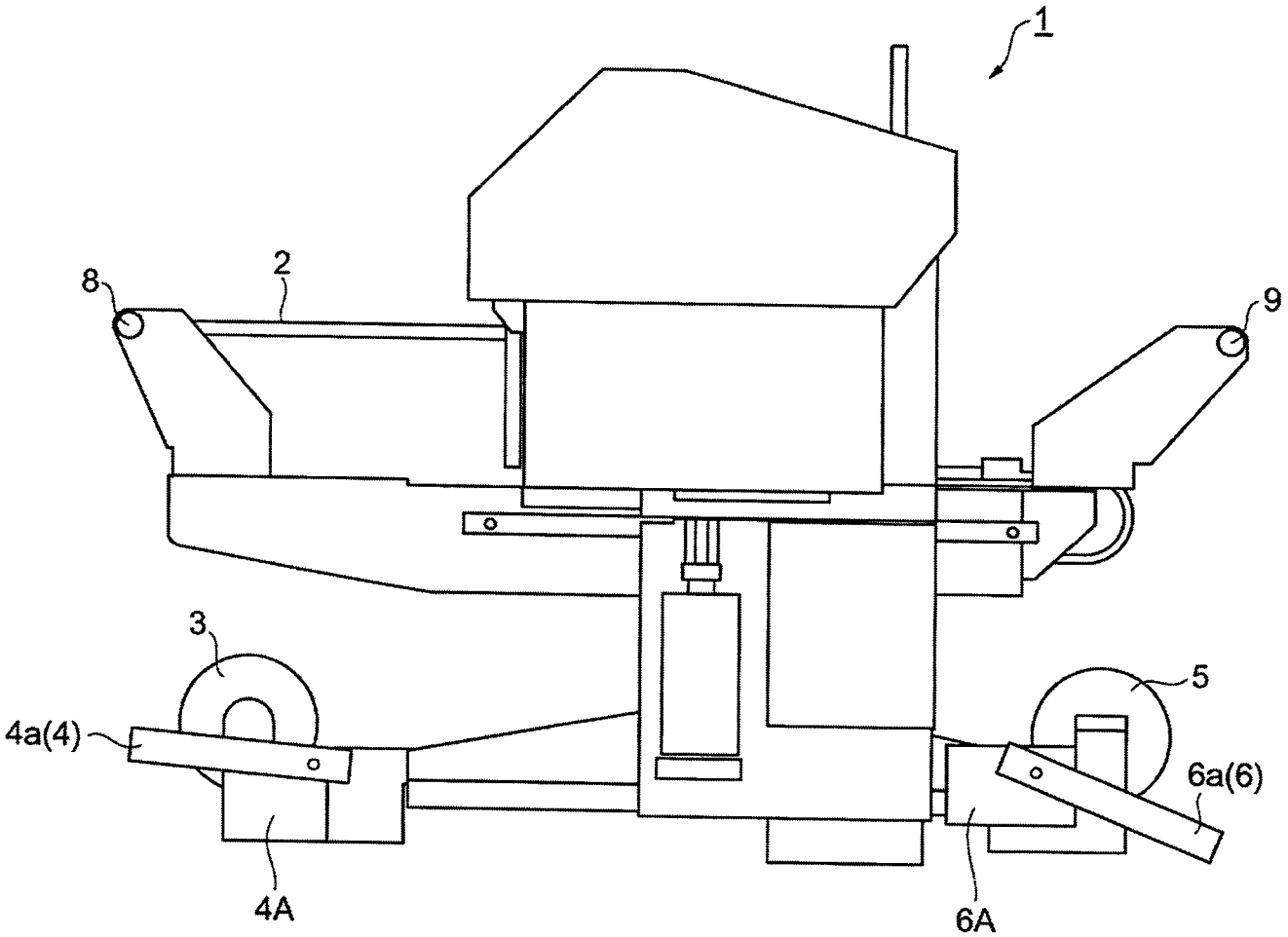
FIG. 3 is a side view of the ink-jet printer shown in FIG. 1.

Explanation continues, while referring again to FIG. 1 through FIG. 3. The winding roller 5 may be a portion for winding the roll paper 'M', which may be already printed, from the table 2. The winding roller 5 may be cylindrical and may be provided in a winding unit 6A positioned at a front side of the table 2 in the transfer direction of the medium. The winding roller 5 may wind the roll paper 'M' by using a drive unit (not shown), such as a motor, and the drive unit for driving the winding roller 5 may be controlled by the control unit. The amount of the roll paper 'M' to be wound by the winding roller 5 may be adjusted through controlling the drive unit by the control unit, in accordance with the amount of unwound from the unwinding roller 3, a count value of an encoder detecting an RPM of the winding roller 5, and so on. Furthermore, the winding roller 5 also may unwind the roll paper 'M' for the purpose of maintaining a height of the second tension bar 6 to be described later.

The second tension bar 6 may be a portion for providing tension for the roll paper 'M' to be wound by the winding roller 5. The second tension bar 6 may be freely movable in a vertical direction (a direction of gravity), in the same way as the first tension bar 4 may be. Concretely to describe, the second tension bar 6 may include a pair of support members 6*a* provided to the winding unit 6A of the ink-jet printer 1 to be able to freely turn, and a contacting member 6*b* that may be supported by the support members 6*a* and may contact the roll paper 'M.' The contacting member 6*b* may be cylindrical and may be provided along a direction in which the winding roller 5 stretches out.

The second tension bar 6 may be placed in such a way as to contact the rear surface of the roll paper 'M' within an interval between the winding roller 5 and the roller 9 in order to provide tension to the roll paper 'M. Meanwhile, the second tension bar 6 may weigh, for example, approximately 1.5 kg. Thus, owing to such a structure, the second tension bar 6 may pull down the placed roll paper 'M' with its own weight within an interval between the winding roller 5 and the roller 9. Then, the tension (load) to be provided to the roll paper 'M' at the second tension bar 6 may be adjusted, for example, by installing a weight (load). Incidentally, the contacting member 6*b* may be provided to the support members 6*a* so as to be freely rotatable.

Figure 5:
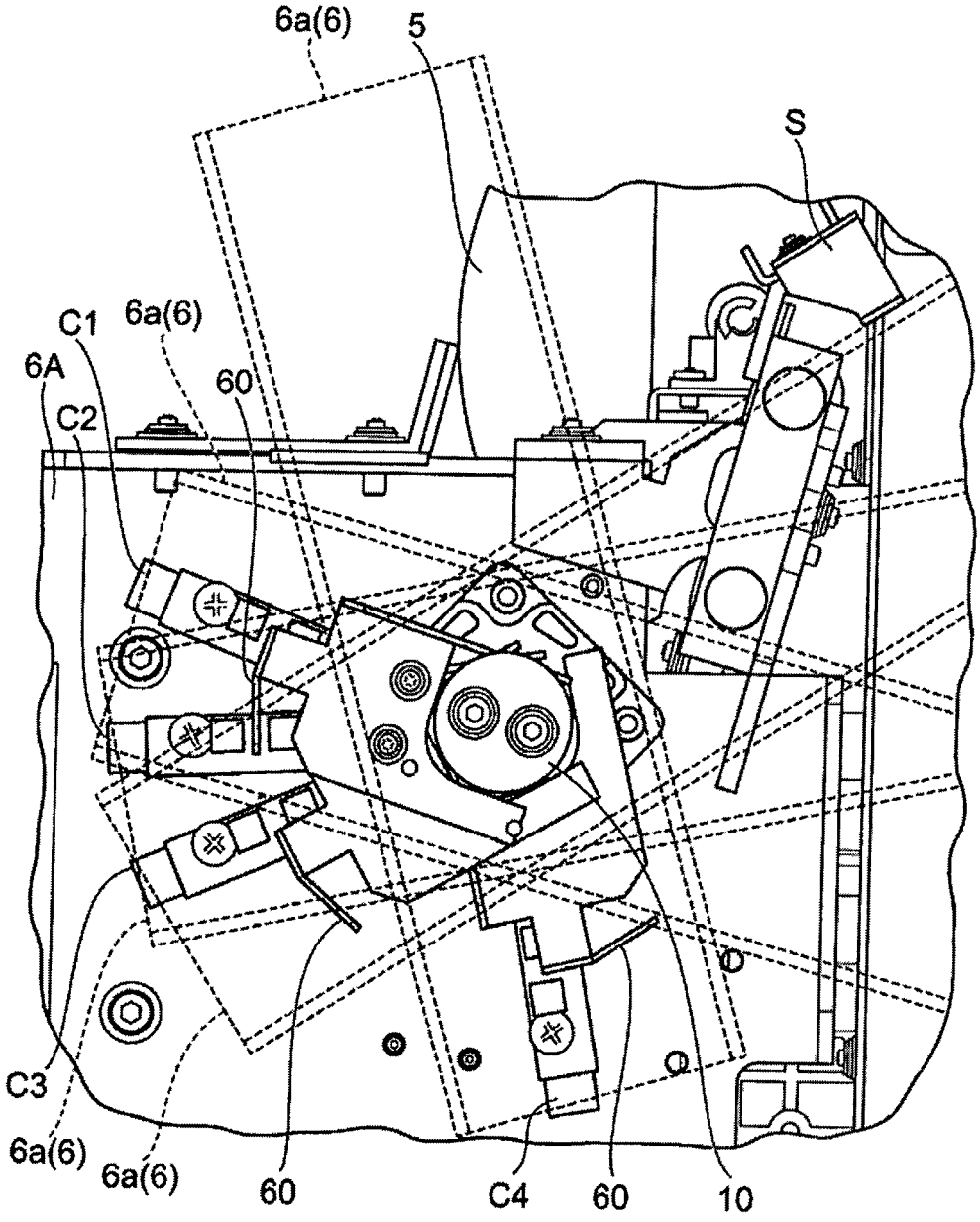
FIG. 5 is an enlarged view of a winding unit according to an exemplary embodiment of the present invention.

Furthermore, the winding unit 6A may be provided with a plurality of sensors in a similar configuration as the first through fourth sensors C1-C4 provided for the unwinding unit 4A. As shown in FIG. 5, the winding unit 6A may support a turning axis of the support members 6*a* and may be provided with four sensors C1-C4 at a side section of the winding unit 6A. Each of the sensors C1-C4 may be a sensor for detecting an elevation of the contacting member 6*b* of the second tension bar 6. Specifically, a first sensor C1 may be provided in the winding unit 6A at a position that is at an upper side in relation to an elevation of a support shaft 10 supporting the second tension bar 6, the position also may be towards a left side in relation to a center of the support shaft 10 in the drawing. The first sensor C1 may detect an elevation of the contacting member 6*b* being at a lowest position by means of detecting a position of one end (being opposite to the other end where the contacting member 6*b* is provided) of the support members 6*a*. The lowest position may be located where the contacting member 6*b* is approximately 20 to 30 mm above a floor level.

A second sensor C2 may be provided in the winding unit 6A at a position having an elevation similar to the elevation of the support shaft 10, the position also may be towards the left side in relation to the center of the support shaft 10 in the drawing. Together with the first sensor C1, the second sensor C2 may detect the elevation of the second tension bar 6 being at the lowest position, by means of detecting the position of the one end of the support members 6*a*. Furthermore, together with a third sensor C3 to be described later, the second sensor C2 may detect a first operating position of the second tension bar 6 by means of detecting a position of the one end of the support members 6*a*. The first operating position may be at an elevation where the second tension bar 6 is around an intermediate position; and at the elevation, the winding roller 5 may start its winding operation. In other words, if the second sensor C2 turns on, the winding roller 5 may start winding the roll paper 'M' in order to maintain the second tension bar 6 at the first operating position.

The third sensor C3 may be provided in the winding unit 6A at a position that is at a lower side in relation to the elevation of the support shaft 10, the position also may be towards the left side in relation to the center of the support shaft 10 in the drawing. Together with the second sensor C2, the third sensor C3 may detect the first operating position of the second tension bar 6 by means of detecting the position of the one end of the support members 6*a*. Furthermore, the third sensor C3 may detect a second operating position of the second tension bar 6. The second operating position may be located where the second tension bar 6 is at an upper point, and there the winding roller 5 may start its unwinding operation. In other words, if the second sensor C2 turns off under the condition of the third sensor C3 being on, the winding roller 5 may start unwinding the roll paper 'M' in order to maintain the second tension bar 6 at the second operating position.

A fourth sensor C4 may be provided in the winding unit 6A at a position that is at the lower side in relation to the elevation of the support shaft 10, the position also may be towards a right side in relation to the center of the support shaft 10 in the drawing. The fourth sensor C4 may detect an evacuation position of the second tension bar 6 by means of detecting the position of the one end of the support members 6*a*. The evacuation position may be where the second tension bar 6 is at its highest position, and there the roll paper 'M' is replaced or installed.

The first through fourth sensors C1-C4 described above may be, for example, optical sensors, and these sensors may detect an elevation of the second tension bar 6 by using a masking plate 60 provided to the second tension bar 6, which may interrupt the transmission of infrared light. The masking plate 60 may be provided at the one end of the second tension bar 6 in such a way that the masking plate 60 reacts against two sensors, while extending over the two sensors. In other words, the masking plate 60 may be structured to individually interrupt the transmission of the infrared light of two neighboring sensors. In the case where none of the first through fourth sensors C1-C4 detects the masking plate 60, i.e., the masking plate 60 may be positioned between the third sensor C3 and the fourth sensor C4, it may be supposed that the second tension bar 6 is placed at a mechanical limit position. The mechanical limit position may be where a wrinkle-removing operation for the roll paper 'M' as described later is executed; and furthermore, the mechanical limit position may be where the second tension bar 6 contacts a stopper 'S' provided to the winding unit 6A. Alternatively, the first through fourth sensors C1-C4 may include magnetic sensors and the like, instead of optical sensors.

The control unit described above may control the drive unit for the unwinding roller 3 to unwind and wind the roll paper 'M' according to an elevation detected by each of the first through fourth sensors C1-C4, in such a way that the second tension bar 6 may operate (move vertically) within a predetermined working range with respect to the elevation.

Figure 6:
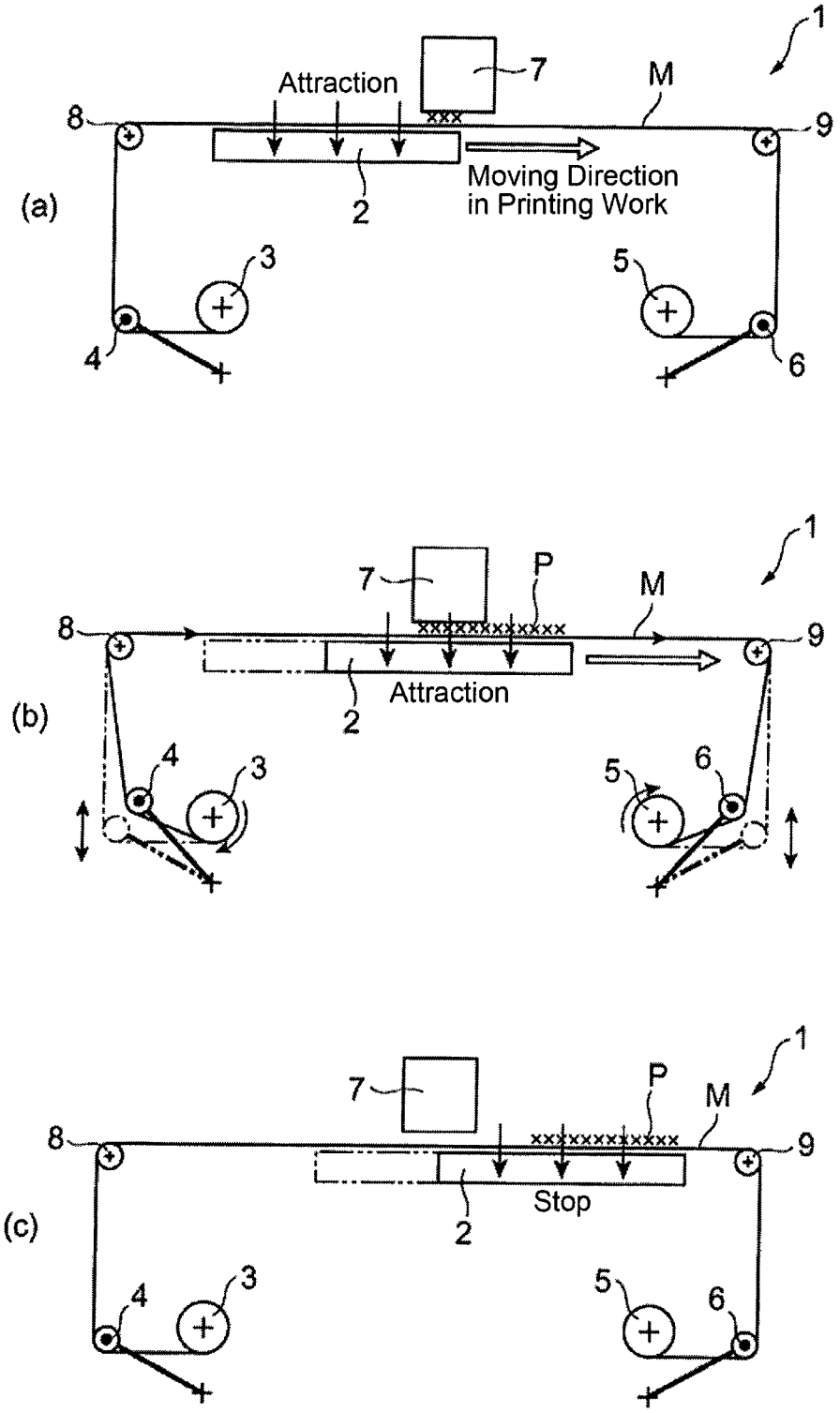
FIGS. 6*a*-6*c* are side views representing steps of a medium transfer method according to an exemplary embodiment of the present invention.
Figure 7:
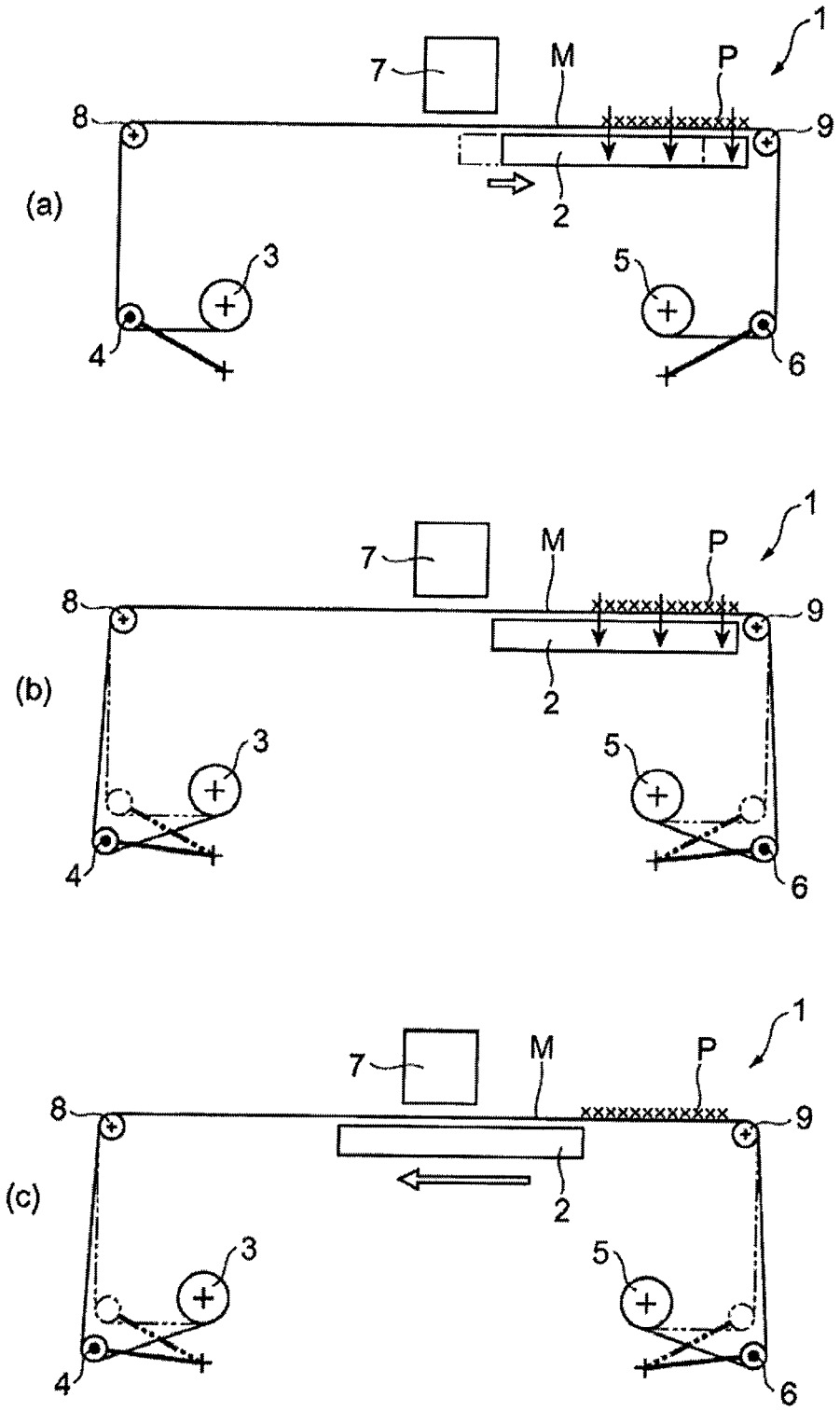
FIGS. 7*a*-7*c* are side views representing steps of a medium transfer method according to an exemplary embodiment of the present invention.
Figure 8:
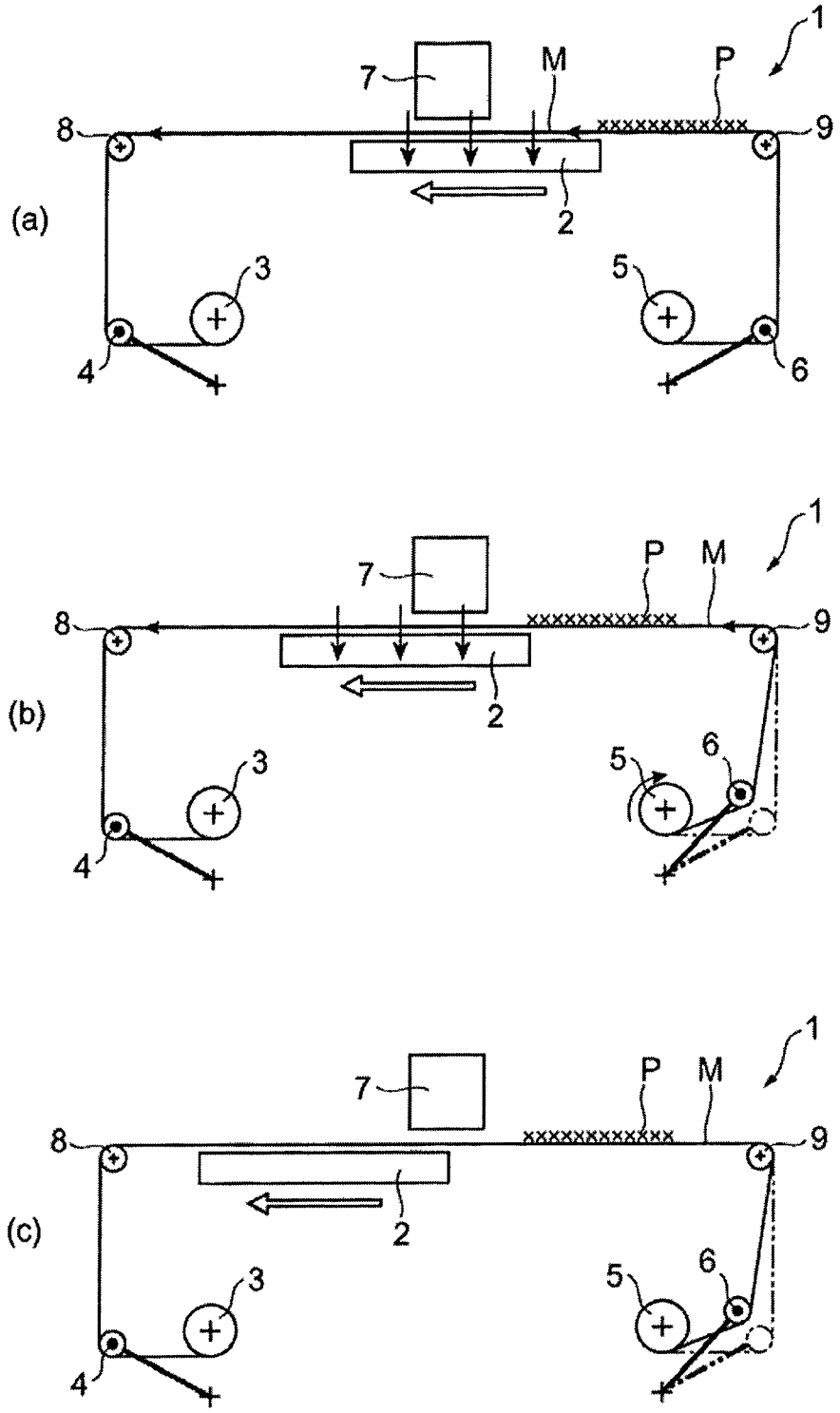
FIGS. 8*a*-8*c* are side views representing steps of a medium transfer method according to an exemplary embodiment of the present invention.

A medium transfer method for the ink-jet printer 1 described above is explained with reference to FIGS. 6-8. Incidentally, FIGS. 6-8 are drawings that are correspond to an embodiment of a medium transfer method. In FIGS. 6-8, the left-hand side of each of the drawings corresponds to the backside (rear side) of the ink-jet printer 1; accordingly, the right-hand side of each of the drawings corresponds to the forehead side (front side) of the ink-jet printer 1.

At first, the roll paper 'M' may be set in the ink-jet printer 1, as shown in FIG. 6A. Concretely to describe, the roll paper 'M' unwound from the unwinding roller 3 may be hung over an outer side of the first tension bar 4. Then, after passing by the roller 8, the roll paper 'M' may be placed on the table 2. Subsequently, after passing by the roller 9, the roll paper 'M' may be hung over an outer side of the second tension bar 6, and then the winding roller 5 may wind the roll paper 'M.' In the situation, the table 2 may move from a rear end position of the ink-jet printer 1, as a position in an initial state; namely, a position having a condition where an edge portion of the table 2 is adjacent to the roller 8; to a position having a condition where part of the table 2 enters a printing area of the printing head 7.

Then, the roll paper 'M' may be attracted on the table 2, and printing may start. Next, the printing may be carried out through a scanning motion of the printing head 7 (head unit) as shown in FIG. 6B, the table 2 may move from the rear side to the front side of the ink-jet printer 1 while attracting the roll paper 'M.' In accordance with the transfer motion of the table 2 at the time, the unwinding roller 3 may unwind the roll paper 'M', and meanwhile the winding roller 5 may wind the roll paper 'M.' Moreover, the first tension bar 4 and the second tension bar 6 may move vertically in accordance with the motion of unwinding and winding the roll paper 'M' so as to provide the roll paper 'M' with a predetermined tension. The unwinding roller 3 and the winding roller 5 may unwind and wind the roll paper 'M' in such a way as to keep the first tension bar 4 and the second tension bar 6 within a range between the first operating positions and the second operating positions.

Then, at the time when the printing finishes as shown in FIG. 6C, the table 2 may stop its moving operation, and the unwinding roller 3 and the winding roller 5 also may stop their operation.

Then, after finishing the printing, the table 2 may move in a direction towards the front side of the ink-jet printer 1 in such a way that a printed portion 'P' (indicated with "x" marks in the drawings), which is printed on the roll paper 'M', may be located outside the printing area of the printing head 7 (i.e., at a frontward area next to a position of the printing head 7), as shown in FIG. 7A. Simultaneously, the table 2 may still attract the roll paper 'M.' Subsequently, after the move of the table for locating the table itself outside the printing area as shown in FIG. 7B, operation of the unwinding roller 3 and the winding roller 5 may be controlled to have the first tension bar 4 and the second tension bar 6 at their lowest positions, namely so as to turn on the first sensor C1 and the second sensor C2.

Next, the table 2 may release the roll paper 'M' from attraction. At the time, air may be blown out of the holes 'H' of the table 2 in order to float the roll paper 'M' off the table 2. Then, as shown in FIG. 7C, the table 2 may move backward for a predetermined distance. The predetermined distance may be a distance obtained as a result of subtracting a distance for wrinkle-removing operation from a specified distance for page ejection (page ejection distance). The distance for wrinkle-removing may be specified arbitrarily, and it also may be specified by means of changing a parameter with an operation panel (not shown) of the ink-jet printer 1. Concretely to describe, for example, the distance for wrinkle-removing may be specified to be 30 mm as an initial setting value, and it may be specified within a range of 10 to 100 mm by one millimeter.

Subsequently, as shown in FIG. 8A, the table 2 may again start attracting the roll paper 'M', and operation of the unwinding roller 3 and the winding roller 5 may be controlled to maintain the first tension bar 4 and the second tension bar 6 at their first operating positions, namely so as to turn on the second sensor C2 and the third sensor C3. At the same time, the table 2 may move backward so as to be located at a predetermined position. The predetermined position may be defined by adding the distance for wrinkle-removing and a page interval correction distance to a position values of a print start position. The page interval correction distance may be specified in order to correct a difference that each unit 6A may have (each unit may have a specific difference), because each unit 6A may have a different angle from the mechanical limit position, to be detected by the third sensor C3 and the fourth sensor C4, until a position where the second tension bar 6 actually contacts the stopper 'S.' The page interval correction distance may be specified, for example, to be 0 mm as an initial setting value, and it may be specified within a range of 0 to 100 mm by one millimeter. Incidentally, in the case where the page ejection distance exceeds 600 mm, the steps of releasing the roll paper 'M' from attraction by the table 2, moving the table 2 for the predetermined distance, and starting attraction of the roll paper 'M' by the table 2, may be repeated.

Then, as shown in FIG. 8B, operation of the unwinding roller 3 and the winding roller 5 may be controlled to have the second tension bar 6 at the mechanical limit position, i.e., where none of the sensors C1-C4 reacts; and so as to have the second tension bar 6 at a position between the third sensor C3 and the fourth sensor C4. If the second tension bar 6 is located at the mechanical limit position, the winding roller 5 may become locked and the table 2 may move backward for a distance for wrinkle-removing, as shown in FIG. 8C, so that the table 2 may be located at the print start position having a condition where part of the table 2 may enter a printing area of the printing head 7. On this occasion, the roll paper 'M' may be fixed and not moving, and furthermore the second tension bar 6 may be in a locked state, and in the meantime the table 2 may move backward while attracting the roll paper 'M.' In this way, the table 2 may move backward while attracting the roll paper 'M', and therefore a wrinkle of the roll paper 'M' caused by the attraction may be removed. In the end, the drive unit for the winding roller 5 may be controlled to have the second tension bar 6 under a condition of the first operating position.

Incidentally, operation of removing a wrinkle from the roll paper 'M', as shown in FIG. 7B through FIG. 8C may be carried out at the start of, for example, printing after receiving a page ejection command, on-line printing after internal pattern printing, internal pattern printing after continuously executing an internal pattern so as to exceed 300 mm, and internal pattern printing after executing an internal pattern and an execution of clearing data, and so on. Furthermore, the operation of removing a wrinkle also may be carried out at the start of initial printing after turning on the ink-jet printer 1, or setting "ON" for roll units (i.e., the unwinding unit 4A and the winding unit 6A) as well as the start of printing after detecting the evacuation position of the first tension bar 4 and the second tension bar 6, and so on.

As described above, at the time of printing on the roll paper 'M' in the ink-jet printer 1, the roll paper 'M' may be unwound from the unwinding roller 3 and may be wound by the winding roller 5, while the table 2 moving in accordance with the printing, with the roll paper 'M' being attracted by the table 2. Thus, the roll paper 'M' may be transferred while being fixed onto the table 2 by attraction at the time of the printing, therefore this operation may prevent the roll paper 'M' from having a wrinkle or a bend at the time of the transfer. Accordingly, this operation may prevent an ink discharge position from being displaced due to such a displacement at the time of transferring the roll paper 'M.' As a result, it may become possible to maintain printing quality in the printing on the roll paper 'M.'

Furthermore, since the table 2 and the roll paper 'M' are transferred together while the table 2 is attracting the roll paper 'M', page ejection may be carried out page-by-page, even in the case of printing on the roll paper 'M.'

Moreover, since the first tension bar 4 and the second tension bar 6 may be provided, their own weight may tension the roll paper 'M' placed on the table 2. Therefore, centering correction may be carried out for the roll paper 'M' placed on the table 2 so that the roll paper 'M' may be transferred more stably. Accordingly, this operation may prevent the roll paper 'M' under printing at the time from displacement so that a wrinkle, a distortion, and the like due to displacement of the roll paper 'M' may be suppressed. As a result, inconvenience may be avoided.

Furthermore, in the ink-jet printer 1, when page ejection is carried out after finishing the printing, the table 2 attracting the roll paper 'M' may move in a direction opposite to the transfer direction under a condition where the winding roller 5 may be in a stopped state; namely, a transfer of the roll paper 'M' in the direction opposite to the transfer direction may be blocked; and furthermore the second tension bar 6 may be in a locked state. Thus, when the table 2 attracting and fixing the roll paper 'M' moves, the table 2 may drag away the roll paper 'M' so as to smooth a wrinkle caused due to attraction by the table 2. In the meantime, if the second tension bar 6 is not in a locked state, the second tension bar 6 may move in accordance with the movement of the table 2 to a position where the second tension bar 6 may become locked. Then, since the roll paper 'M' may move in accordance with the movement of the table 2, the roll paper 'M' with a wrinkle caused through the attraction may not be smoothed as long as the second tension bar 6 may keep on moving. On this occasion, the winding roller 5 may be locked in order to fix the roll paper 'M' and not move it, and moreover the second tension bar 6 may be locked, so that the roll paper 'M' with the wrinkle caused through the attraction may be smoothed.

The present invention is not limited to the embodiment described above. For example, as described in the above embodiment, the table 2 may be equipped with a mechanism for blowing air. With such a mechanism, in the case of a heavy medium for example, friction between the medium and the table 2 may be reduced when the table 2 moves back to an initial position after finishing the printing. Accordingly, displacement of a printing position due to such friction may be suppressed.

What is claimed is:

1. An inkjet printer comprising:

a placement section configured to attract a rolled medium by vacuum, to move in a first direction parallel to a medium transferring direction from an original position, and to move in a second direction parallel to the medium transferring direction to the original position;

an ink discharging unit configured to move in a direction perpendicular to the medium transferring direction;

an unwinding section configured to unwind the medium onto the placement section;

a winding section configured to wind the medium from the placement section;

tension bars to provide a tension to the medium including a first tension bar associated with the unwinding section and a second tension bar associated with the winding section; and wherein the placement section is disposed in a traveling path of the medium between the first and second tension bars;

wherein when the ink discharging unit discharges ink on the medium, the placement section attracts the medium and moves in the first direction parallel to the medium transferring direction from the original position, the unwinding section unwinds the medium on the placement section, and the winding section winds the medium from the placement section;

wherein the placement section releases the medium and moves in the second direction parallel to the medium transferring direction to the original position while the tension bars apply the tension to the medium; and wherein the placement section moves in the second direction parallel to the medium transferring direction while the placement section attracts the medium by vacuum and while the second tension bar is locked to thereby remove a wrinkle from the medium.

2. The ink-jet printer according to claim 1, wherein the medium is tensioned by the weight of at least one of the tension bars.

3. The ink-jet printer according to claim 1, wherein the winding section is configured to be locked; and wherein the placement section is configured to move in the second direction parallel to the medium transferring direction while the winding section is locked.

4. The ink-jet printer according to claim 1, wherein the second tension bar is configured to be locked while the winding section is locked.

5. A medium transfer method for an ink-jet printer comprising the steps of:

attracting a medium to a placement section by vacuum;

moving the placement section on a traveling path of the medium between tension bars in a first direction parallel to a medium transferring direction from an original position;

moving a head unit in a direction perpendicular to the medium transferring direction;

unwinding the medium onto the placement section;

discharging ink on the medium by the head unit;

winding the medium from the placement section;

moving the placement section on the traveling path of the medium between the tension bars in a second direction parallel to the medium transferring direction to the original position;

releasing the medium from the placement section; and tensioning the medium with the tension bars;

moving the placement section in the second direction parallel to the medium transferring direction while the placement section attracts the medium by vacuum and while the second tension bar is locked to thereby remove a wrinkle from the medium;

wherein discharging ink on the medium occurs while attracting the medium to the placement section, while moving the placement section in the first direction parallel to the medium transferring direction from the original position, while unwinding the medium on the placement section, and while winding the medium from the placement section; and wherein releasing the medium from the placement section and moving the placement section on the traveling path of the medium between the tension bars in the second direction parallel to the medium transferring direction occurs while tensioning the medium with the tension bars.

6. The medium transfer method according to claim 5, further including locking the winding section;

wherein locking the winding section occurs while attracting the medium to the placement section, and while moving the placement section on the traveling path of the medium between the tension bars in the second direction parallel to the medium transferring direction.

* * * * *